US005271669A

United States Patent [19]

Pearlson

[11] Patent Number: 5,271,669

[45] Date of Patent: Dec. 21, 1993

[54] TRANSPORTABLE KIOSK

[76] Inventor: Douglas L. Pearlson, P.O. Box 56000U, Miami, Fla. 33256-0106

[21] Appl. No.: 785,655

[22] Filed: Oct. 31, 1991

[51] Int. Cl.[5] ..... A47B 81/06

[52] U.S. Cl. ..... 312/7.2; 312/3.6; 312/223.3

[58] Field of Search ..... 312/7.2, 249.2, 249.3, 312/249.7, 313, 323.2, 316, 223.3; 359/405, 429

[56] References Cited

U.S. PATENT DOCUMENTS

| | | | |
|---|---|---|---|
| 4,842,402 | 6/1989 | Wise | 312/7.2 |
| 5,033,804 | 7/1991 | Faris | 312/223.3 |
| 5,044,738 | 9/1991 | Shaffer | 359/429 |
| 5,087,010 | 2/1992 | Walters | 312/7.2 |

*Primary Examiner*—Peter R. Brown
*Assistant Examiner*—Gerald A. Anderson
*Attorney, Agent, or Firm*—Mason, Fenwick & Lawrence

[57] ABSTRACT

A kiosk base preferably in the shape of a vertical round cylinder of a particular diameter and having a top surface lying in a sloping plane which makes a first acute angle with the rear of said base and a first obtuse angle with the front of said base. On the base rests a top cover in the shape of a round cylinder rotatable with respect to said base and having the same diameter. The cover includes a bottom surface that faces said base top surface, with said cover bottom surface lying in a plane which makes a second acute angle with the rear of said cover and makes a second obtuse angle with the front of said cover, where the cover second acute angle is substantially equal to the base first acute angle and the cover second obtuse angle is substantially equal to the base first obtuse angle. This relationship permits the cover to extend beyond the base wall when the kiosk is in use, yet become aligned with the base wall when the cover is rotated during its storage or transport phase.

20 Claims, 2 Drawing Sheets

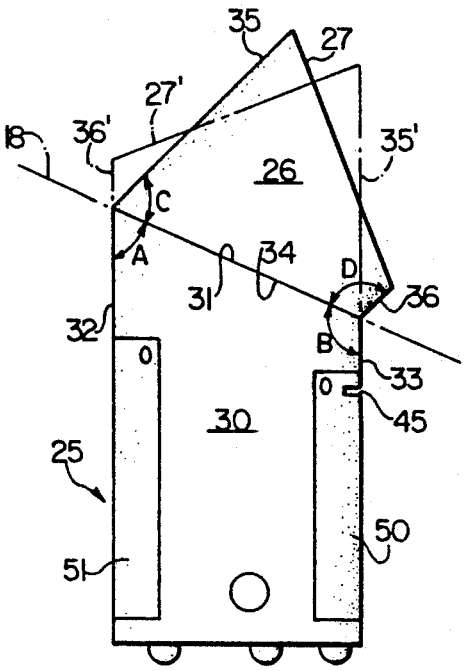
FIG. 6
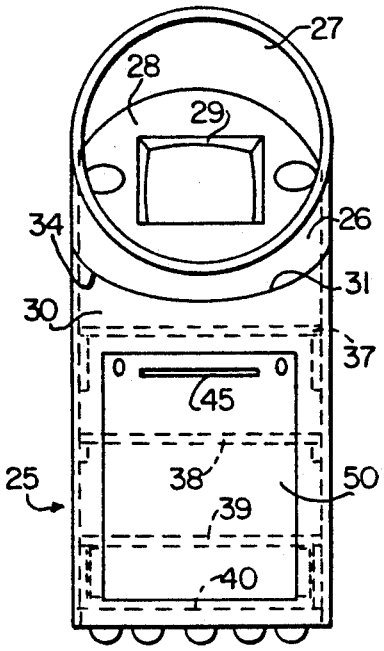
FIG. 7
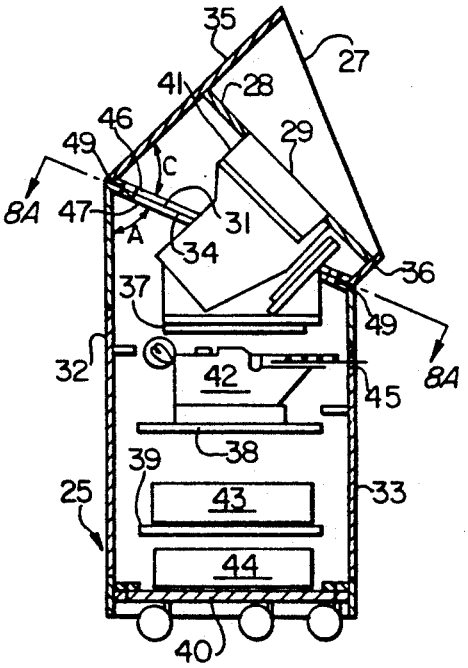
FIG. 8
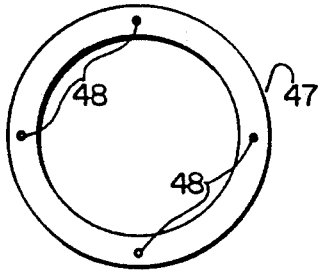
FIG. 8A
FIG. 9
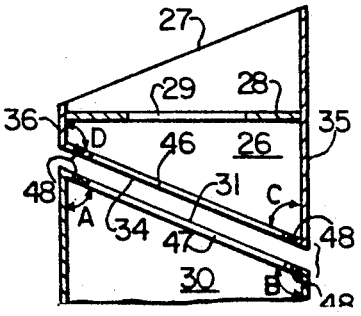

TRANSPORTABLE KIOSK

FIELD OF THE INVENTION

The present invention relates to compact portable kiosk structures for supplying information to a viewer. In particular, the present invention comprises a kiosk which can be assembled in one configuration for its intended use and reassembled in another configuration for compact storage or transport.

BACKGROUND AND SUMMARY OF THE INVENTION

Small portable kiosks or stands are well known for displaying or providing information to persons at meetings or in other surroundings. Quite often, however, their structure is somewhat incompatible with, or represents a compromise between, the ease or aesthetics of viewing the displayed information and/or their compactness during storage and transport. This is especially true where the kiosk is designed with a top cover that projects beyond the vertical walls of its base so that several kiosks cannot be closely packed together or are awkward to handle when not in use.

Accordingly, it is a primary object of the present invention to provide a kiosk structure which can be assembled with its top cover in one configuration for its intended use, and reassembled with its top cover in another configuration for the purpose of compact storage or transport.

Another primary object of the present invention is to permit the top cover on a vertical kiosk base to extend in one direction beyond said base for viewer convenience or appeal in using the kiosk, yet allow the kiosk to be reconfigured with its cover facing the opposite direction for reducing the space needed to store or transport the kiosk.

These and other objects of the present invention are generally achieved by providing a kiosk base preferably in the shape of a vertical round cylinder of a particular diameter and having a top edge surface lying in a sloping plane which makes a first acute angle with the rear of said base and a first obtuse angle with the front of said base. On the base rests a top cover in the shape of a round cylinder rotatable with respect to said base and having the same diameter. The cover includes a bottom edge surface that faces said base top surface, with said cover bottom surface lying in a plane which makes a second acute angle with the rear of said cover and makes a second obtuse angle with the front of said cover, where the cover second acute angle is substantially equal to the base first acute angle and the cover second obtuse angle is substantially equal to the base first obtuse angle. This relationship permits the cover to extend beyond the base wall when the kiosk is in use, yet become aligned with the base wall when the cover is rotated during its storage or transport phase.

BRIEF DESCRIPTION OF DRAWINGS

FIG. 6 is a side elevation view of a second kiosk embodiment.

FIG. 7 is a front elevation view of the second kiosk embodiment.

FIG. 8 is a side elevation sectional view of the second kiosk embodiment which also shows typical information display items that may be contained therein.

FIG. 8A is a sectional view of the second kiosk embodiment taken along line 8A—8A in FIG. 8 and which only shows the inner connecting flange of the base.

FIG. 9 is sectional view of the second kiosk embodiment with its cove rotated 180 degrees with respect to its base.

DETAILED DESCRIPTION

Figure 3:
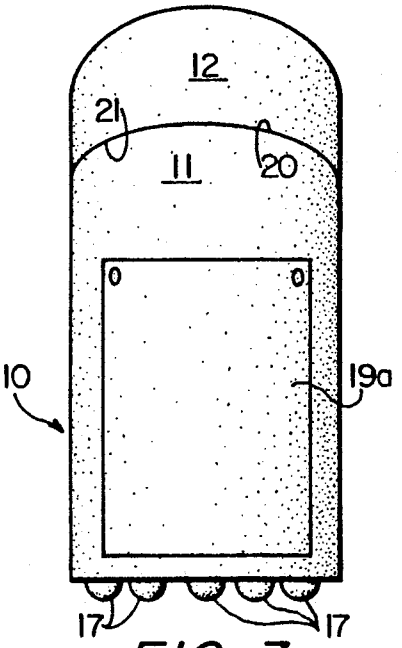
FIG. 3 is a rear elevation view of the first kiosk embodiment.
Figure 5:
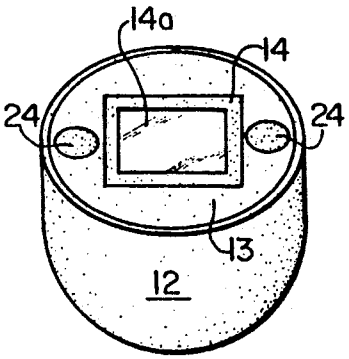
FIG. 5 is a top plan view of the first kiosk embodiment.

In describing the subject invention illustrated in the drawings, specific terminology is used for the sake of clarity. However the invention is not intended to be limited to the specific terms so selected, and each specific term includes all technically equivalent terms for components operating in a similar manner to accomplish a similar purpose.

FIGS. 1–5 are various views of a first kiosk embodiment according to the present invention, while FIGS. 6–9 show a second kiosk embodiment which primarily differs from said first embodiment in the shape of its top cover.

Figure 2:
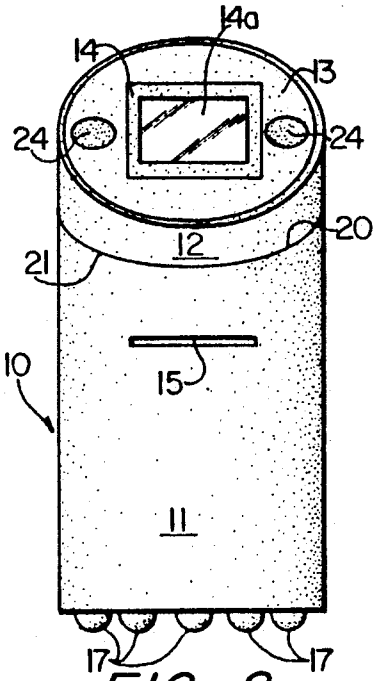
FIG. 2 is a front elevation view of the first kiosk embodiment.
Figure 4:
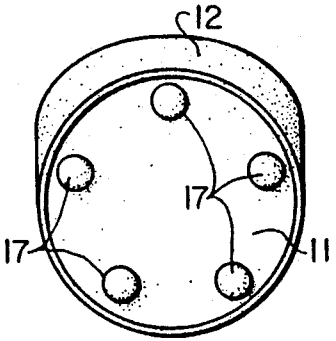
FIG. 4 is a bottom view of the first kiosk embodiment.
Figure 1:
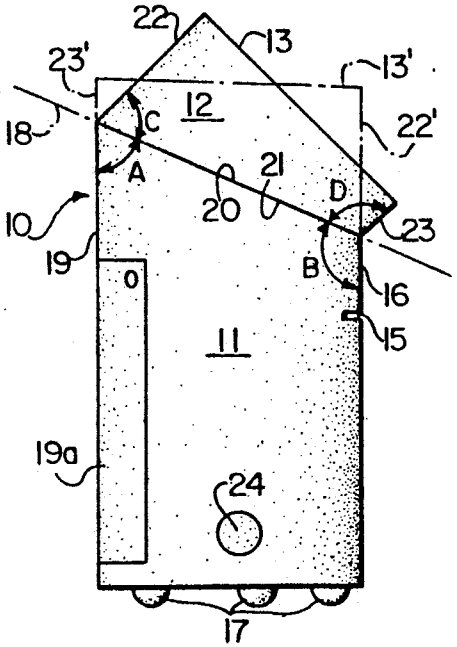
FIG. 1 is a side elevation view of a first kiosk embodiment.

In FIGS. 1–5, the kiosk 10 consists of two major components, namely, a base unit 11 which supports a top cover unit 12. The base 11 preferably is an upstanding or vertical round hollow cylinder which is adapted to contain various pieces of equipment or other items according to the purpose for which the kiosk is used. For example, the FIG. 2 front view and the FIG. 5 top view show that the upper face 13 of cover 12 can include a window 14 for viewing image providing means such as an internal monitor screen **14*a*, while a printer paper output slot 15 can be provided in the front wall 16 of the base as shown in FIGS. 1 and 2. The base has a circular cross-sectional configuration as evidenced by the base bottom view in FIG. 4 which also shows foot pads 17. As further illustrated in the FIG. 3 rear view, a door panel 19*a* is provided in the rear wall 19 of base 11** for access to the interior of the base.

As best shown in the side elevation view of FIG. 1, the cylindrical base 11 is also truncated at its top along an oblique cutting plane 18 which is slanted downwardly from the base rear wall 19 to the base front wall 16. Thus, the base top edge surface 20 lies in an oblique plane which is at an acute interior angle A with the vertical base rear wall 19, and is at an obtuse interior angle B with the vertical base front wall 16. Preferably, angle A is about 67 degrees so that angle B is about 113 degrees (180−67).

The kiosk cover 12 in FIGS. 1–5 rests on top of base 11 and is removably secured thereto by means later described in connection with FIGS. 8, 8A and 9. Cover 12 also is preferably shaped as a round hollow cylinder having a circular cross-section configuration of the same diameter as base 11. The cover also has an oblique bottom edge surface 21 which faces and abuts the base top edge surface 20. The cover's bottom edge surface 21 also lies in a second oblique plane which is at a second acute interior angle C with the rear wall 22 of cover 12, and is at a second obtuse interior angle D with the front wall 23 of the cover. The acute angle C is made substantially equal to the acute base angle A, while the obtuse cover angle D is made substantially equal to the obtuse base angle B for reasons to be described. Apertures 24 in the cover and base are for ventilation and other purposes.

When the kiosk of FIGS. 1-5 is installed at an exhibition or a meeting, cover 12 is placed on top of base 11 in the canted position shown by the solid cover outline in FIG. 1 so that its upper face 13 is easily visible to a viewer standing in front of the kiosk. Opposite wall elements of cover 12 are parallel to each other, as illustrated by walls 22 and 23. In the side elevation view of FIG. 1, cover 12 is canted toward the front of the kiosk which also gives a pleasing appearance. For storage and transportation purposes, however, cover 12 is rotated 180 degrees with respect to base 11 which causes the cover to assume the dot-dash line position in FIG. 1. Since the base interior angle A is equal, or substantially so, to the cover interior angle C, and the base interior angle B is substantially equal to the cover interior angle D, the resulting kiosk elevation profile now has straight vertical walls along its entire length. For example, the cover front wall 23 (23' in its rotated position) is now vertically aligned with the vertical base rear wall 19, while the cover rear wall 22 (22' in its rotated position) is vertically aligned with the vertical base front wall 16. The base and cover side walls remain in alignment as they previously were in FIGS. 2 and 3. This realignment of the cover 12 from a canted to a vertical position results in a cylindrical configuration for the kiosk 10 to reduce the maximum front to rear dimension and height dimension to thereby permit the kiosk to be packed in a square box of reduced size both in height and width. Similarly, a closer spacing of several kiosks that are being stored or transported to another site is also resultant from the repositioning of the cover to the dot-dash line position.

As previously noted, FIGS. 6-9 illustrate a second kiosk embodiment 25 whose round cylindrical cover 26 differs somewhat in shape from the cover 12 shown in FIGS. 1-5. Cover 26 in FIGS. 6-9 includes a hood 27 extending beyond its upper face 28 which in turn can include an image providing means such as a monitor display window 29 as shown by the FIG. 7 front elevation view. This cover 26 rests on the vertical round cylindrical base 30 and has the same relationship thereto as the cover 12 and base 11 in FIGS. 1-5. That is, the plane of the base top edge surface 31 slants downwardly from rear to front and makes interior acute and obtuse angles A and B, respectively, with the base rear wall 32 and the base front wall 33. The cover bottom edge surface 34 also lies in a plane making interior acute and obtuse angles C and D, respectively, with the cover rear wall 35 and cover front wall 36, where cover angle C is substantially equal to the base angle A, and cover angle D is substantially equal to base angle B. As before, angle A preferably is about 67 degrees so that angle B is about 113 degrees.

When cover 26 faces to the front of base 30, as shown by the solid cover outline in FIG. 6, the parallel cover rear and front walls 35 and 36 are at an angle with respect to the base vertical rear and front walls 32 and 33. However, if cover 26 is rotated 180 degrees with respect to the base, its walls all become vertical and aligned with the base walls so as to form a space saving unit for storage and transportation purposes. This feature is illustrated by the dot-dash cover outline in FIG. 6, where cover front wall 36 (36' in the rotated position) is vertically aligned with base rear wall 32 and cover rear wall 35 (35' in the rotated position) is vertically aligned with base front wall 33.

FIGS. 8, 8A and 9 show some interior details of the kiosk 25 which also may be included in the kiosk 10 of FIGS. 1-5. The side elevation sectional view of FIG. 8 includes several internal shelves 37, 38, 39 and 40 located within base 30 for respectively supporting items like a monitor 41, a printer 42 and one or more control units 43 and 44. Monitor 41 is viewed through window 29 in the upper face 28 of cover 26, while paper output from printer 42 passes through a slot 45 in the base front wall 33. In order to removably fasten cover 26 to base 30, the cover has an inwardly extending flange member 46 around the circumference of its bottom edge surface 34 that rests on a similar inner flange member 47 around the circumference of the base top edge surface 31. As best shown by flange 47 in the FIG. 8A sectional view, each flange member has four holes 48 spaced thereabout at the 3, 6, 9 and 12 o'clock locations. Correspondingly located holes 48 in flanges 46 and 47 are aligned so that removable peg or bolt fasteners 49 can be inserted therein to keep cover 26 from slipping or otherwise moving with respect to base 30. These fasteners can be withdrawn when it is desired to rotate cover 26 in the 180 degree manner shown by FIG. 9 so that the cover wall becomes vertical and the cover is aligned with the base. If desired, a front access panel 50 can also be provided in the base wall in addition to the rear access panel 51.

Many modifications and variations of the present invention are possible considering the above teachings and specifications. Therefore, within the scope of the appended claims, the invention may be practiced otherwise than as specifically described above.

I claim:

1. A kiosk unit comprising:

(a) a base with vertical supporting structure having a front, a rear, and a top surface lying in a plane which slants downwardly from said rear of said base vertical structure to said front of said base vertical structure, wherein said plane is at a first acute interior angle with said rear of said base vertical structure and is at a first obtuse interior angle with said front of said base vertical structure; and (b) a top cover rotatable with respect to said base and having a bottom surface that faces said base top surface, a front, and a rear, said cover bottom surface lying in a plane which is at a second acute interior angle with said rear of said cover and is at a second obtuse interior angle with said front of said cover, wherein said cover second acute angle is substantially equal to said base first acute angle and said cover second obtuse angle is substantially equal to said base first obtuse angle.

2. The kiosk according to claim 1, wherein said cover is removably secured to said base and additionally including image providing means in said base for providing an image viewable through said cover.

3. The kiosk according to claim 1, wherein said cover bottom surface rests on said base top surface and is removably secured thereto.

4. The kiosk according to claim 3, wherein said base top surface and said cover bottom surface each includes an inwardly extending flange member with holes therein, said holes in said flange members being aligned with each other for receiving fasteners therethrough.

5. A kiosk unit comprising:

(a) a base with vertical supporting structure arranged in a particular cross-sectional configuration and having a front, a rear, and a top surface lying in a plane which slants downwardly from said rear of said base vertical structure to said front of said base vertical structure, wherein said plane is at a first acute interior angle with said rear of said base vertical structure and is at a first obtuse interior angle with said front of said base vertical structure; and (b) a top cover rotatable with respect to said base vertical structure and having the same particular cross-sectional configuration, said cover including a front, a rear, and a bottom surface that faces said base top surface and lies in a plane which is at a second acute interior angle with said rear of said cover and is at a second obtuse interior angle with said front of said cover, wherein said cover second acute angle is substantially equal to said base first acute angle and said cover second obtuse angle is substantially equal to said base first obtuse angle.

6. The kiosk according to claim 5, wherein said particular cross-sectional configuration is a circle.

7. The kiosk according to claim 5, wherein said cover is removably secured to said base.

8. The kiosk according to claim 5, wherein said cover bottom surface rests on said base top surface and is removably secured thereto.

9. The kiosk according to claim 8, wherein said base top surface and said cover bottom surface each includes an inwardly extending flange member with holes therein, said holes in said flange members being aligned with each other for receiving fasteners therethrough.

10. A kiosk unit comprising:

(a) a base in the shape of a vertical round hollow cylinder of a particular diameter and having a front, a rear, and a top surface lying in a plane which slants downwardly from said rear of said base cylinder to said front of said base cylinder, wherein said plane is at a first acute interior angle with said rear of said base cylinder and is at a first obtuse interior angle with said front of said base cylinder; and (b) a top cover in the shape of a round hollow cylinder rotatable with respect to said base cylinder and having the same diameter, said cover including a front, a rear, and a bottom surface that faces said base top surface and lies in a plane which is at a second acute interior angle with said rear of said cover cylinder and is at a second obtuse interior angle with said front of said cover cylinder, wherein said cover second acute angle is substantially equal to said base first acute angle and said cover second obtuse angle is substantially equal to said base first obtuse angle.

11. The kiosk according to claim 10, wherein said cover is removably secured to said base.

12. The kiosk according to claim 10, wherein said cover bottom surface rests on said base top surface and is removably secured thereto.

13. The kiosk according to claim 12, wherein said base top surface and said cover bottom surface each includes an inwardly extending flange member with holes therein, said holes in said flange members being aligned with each other for receiving fasteners therethrough.

14. The kiosk according to claim 10, wherein said cover includes an upper face for presenting information to a viewer.

15. The kiosk according to claim 10, wherein said base first acute angle is around 67 degrees and said base first obtuse angle is around 113 degrees.

16. The kiosk according to claim 10 additionally including image providing means mounted in said base for providing an image visible through said cover.

17. The kiosk according to claim 16, wherein said base and said top cover are of circular cross-sectional configuration.

18. The kiosk according to claim 17, additionally including fastening means for removably securing said cover to said base.

19. The kiosk according to claim 18, wherein said base top surface and said cover bottom surface each includes an inwardly extending flange member, said flange members facingly engaging each other and having holes therein, said holes in said flange members being aligned with each other for receiving said fastening means therethrough.

20. The kiosk according to claim 19, wherein said base first acute angle is around 67 degrees and said base first obtuse angle is around 113 degrees.

* * * * *